US006421514B2

(12) United States Patent
Yamanaka et al.

(10) Patent No.: US 6,421,514 B2
(45) **Date of Patent: *Jul. 16, 2002**

(54) CHARGING DEVICE

(75) Inventors: Toshio Yamanaka, Yao; Yoshiya Kinoshita, Nara; Hideaki Kadowaki, Yamatokoriyama; Naoyuki Harada, Nara, all of (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/570,381

(22) Filed: May 12, 2000

(30) Foreign Application Priority Data

May 28, 1999 (JP) ..... 11-149694

(51) Int. Cl.[7] ..... G03G 15/02
(52) U.S. Cl. ..... 399/169; 399/171
(58) Field of Search ..... 399/169, 170, 399/171, 172, 173, 115; 250/324, 325, 326; 361/229, 230

(56) References Cited

U.S. PATENT DOCUMENTS 3,578,970 A * 5/1971 Michaud et al. ..... 399/169
4,320,956 A * 3/1982 Nishikawa et al. ..... 399/171
4,603,964 A * 8/1986 Swistak ..... 399/169
5,079,668 A * 1/1992 Maeshima ..... 361/229
5,365,317 A * 11/1994 Folkins et al. ..... 399/169
5,412,212 A * 5/1995 Rushing ..... 250/325

FOREIGN PATENT DOCUMENTS

| | | |
|---|---|---|
| JP | 3125358 | 12/1991 |
| JP | 04172379 | 6/1992 |
| JP | 04-230777 | * 8/1992 |
| JP | 10171197 | 6/1998 |

* cited by examiner

*Primary Examiner*—Robert Beatty

(57) ABSTRACT

A charging device which has a grid disposed between a discharge element and the photosensitive drum. The grid is formed of a regulating portion having a mesh configuration for the range opposing the image area on the photosensitive drum and non-regulating portions with openings for the range opposing the non-image area. The flow of ions discharged from the discharge element is regulated as to their passage through the grid thereby so as to be uniform and charge the image area on the photosensitive drum uniformly. The flow of ions reaches the non-image area without being shaded by the grid, so as to enhance the surface potential for prevention against toner adherence.

22 Claims, 10 Drawing Sheets

CHARGING DEVICE

BACKGROUND OF THE INVENTION (1) Field of the Invention

The present invention relates to a charging device for use in an image forming apparatus which forms images with a toner (developer) based on the electrophotographic technique, in particular, relating to a charging device for charging the photosensitive member on which toner images are formed.

(2) Description of the Prior Art

Conventionally, a copier using an electrophotographic system (generally called as a reversal development system) in which the photosensitive drum charged with the same polarity as the toner is exposed to light to form a static latent image and then this static latent image is developed with the toner forming a toner image, includes a charging device for charging the photosensitive drum at a uniform level before exposure, an exposure device, a developing unit and the like, all being arranged around the photosensitive drum. The system also includes a transfer device, a cleaning device and an erasing device.

The photosensitive drum surface is subjected to a series of image forming steps effected by these devices. FIG. 1 shows the processing areas of the different devices on the photosensitive drum A surface. Here, when the lengths of the charging area, exposure area (=image area), developing area, transfer area, cleaning area and erasing area are respectively represented by L1, L2, L3, L4, L5 and L6, the following relations should hold:

$$L2<L1 \text{ or } L3 \text{ or } L4 \quad (1)$$

$$L1 \text{ or } L3 \text{ or } L4<L5<L6 \quad (2)$$

The relationship (1) provides reliable development of the static latent image formed by charging and exposure and reliable transfer of the developed image. Actually, the surface potential becomes unstable or uneven at the boundaries of the charging area, so that it is necessary to provide a predetermined charging margin for the image area. Further, since development becomes unstable or uneven at the boundaries of the developing area, it is necessary to provide a predetermined developing margin for the image area. Since the transfer voltage at the boundaries of the transfer area is unstable and uneven, it is necessary to provide a predetermined transfer margin for the image area. The relationship (2) provides reliable cleaning and erasing of the photosensitive drum surface. That is, the cleaning area needs a cleaning margin with respect to the maximum length among L1 to L4, and the erasing area needs a predetermined erasing margin with respect to the cleaning area. It should be noted that the magnitudes of L1, L3 and L4 are not specified.

However, in such a copier, since the non-image area which is outside the charging area or which is not electrified on the photosensitive drum, is low in potential because of no charge, the toner is liable to adhere to this area during the developing process. Therefore, this configuration has the problem in that the toner adhering to this area will pollute the print paper and the copier interior and also promote toner consumption.

To solve the above problems, Japanese Utility Model Application Laid-Open Hei 3 No.125358 discloses a copier with a scorotron type charging device, which has a grid for adjusting or varying the amount of charge and making the charge distribution uniform in the image area on the photosensitive drum. In this disclosure, it is specified that the grid should have a length greater than the range of the image area and both ends of the grid residing within the charging area but outside the image area should be curved closer to the photosensitive drum side. In comparison with the configuration where the grid is not curved closer to the photosensitive drum side, this disclosure is able to prevent the toner from adhering to sites outside the image area where the absolute value of the surface potential is lower than the absolute value of the developing potential (the surface potential of the charging area has the same polarity as the developing potential because of the reversal developing system) and hence is able to prevent black strip defects on the paper.

FIG. 2 shows a scorotron type charging device. A discharge element 1 for generating charged particles for applying static charge over the photosensitive drum surface is attached to an insulative electrode holder 2 and housed by a charger case 3. Arranged in front of discharge element 1 is a grid 4 that regulates the passage of the particle flow from discharge element 1 so as to make the charge distribution uniform. This grid 4 is engaged at its both ends with claws 6 projected from a holder 5 so that it is supported whilst being tensioned by the holder 5. Designated at 7 is an electrode. Here, a charging device with no grid 4 is called as a corotron type. The scorotron type is superior to the corotron type in its capability to improve the uniformity of the surface potential of the photosensitive drum.

However, since the above configuration in which the grid is curved close to the photosensitive drum side deprives the grid of its flatness across the image area, there occurs another problem in that the uniformity of the potential distribution across the image area is degraded. Further, since the surface potential on the photosensitive drum in the non-image area and outside the charging area is lower in absolute value than the developing potential, the toner will adhere to the areas outside the charging area but within the developing area. This not only consumes unnecessary toner but also increases the waste toner to be collected from the photosensitive drum, leading to reducing the life of the waste toner container. Further, even in a configuration where a cleaning area wider than the range of the developing area is provided as stated above, when the toner is scraped from the photosensitive drum by the cleaning blade, part of the toner will move along the cleaning blade edge toward the sides of the photosensitive drum. In this way, the toner adhering to the areas outside the image area and being left untransferred will cause extra stress on the seal elements arranged at both side ends of the cleaning blade, damaging the sealing performance in an early stage.

In order to solve the above problems, Japanese Patent Application Laid-Open Hei 4 No.172379 discloses a copier having a corotron type charging device. This publication discloses a technique for prevention against the toner adherence as above by setting the charging area at a length greater than the developing area and the image area on the photosensitive drum surface within which the static latent image is formed. Though it is possible to prevent the above-described toner adherence properly, this configuration has no grid and hence is unable to enhance the uniformity of the potential distribution across the image area. Thus, it is not only impossible to expect high quality images but also there is a risk of image defects occurring due to charging unevenness.

Further, there is another problem as follows. To simplify manufacturing, some photosensitive drums are produced so that the conductive substrate of the photosensitive drum is coated with a photosensitive layer, not covering the substrate edges but leaving some uncoated parts a certain distance from the edges. Alternatively, in order to remove the pooling of the application liquid at the edges of the substrate, excessive application of liquid at the edges is wiped off after the application of the photosensitive layer. However, this wiping may cause the electric insulation at the edges to lower compared to the portion from which the photosensitive layer has not been wiped off. When a grid is, in a simple manner, arranged across such a photosensitive drum, the low-insulative portions, that is, the naked substrate edges or the substrate edges from which the photosensitive layer has been wiped off, come close to the grid, so that leakage discharge may occur between them, possibly damaging the photosensitive layer. The same problem also occurs when flanges of the photosensitive drum are formed of a conductive resin or the like in order to ground the substrate.

SUMMARY OF THE INVENTION

In view of the above, it is therefore an object of the present invention to provide a charging device capable of charging the image area uniformly while preventing toner adherence to the non-image area. It is another object of the present invention to provide a scorotron-type charging device which can prevent leakage discharge from the grid to the photosensitive member.

The means for solving the problems according to the present invention is attained by the combination of scorotron and corotron charging modes. The merits of both modes are made use of to uniformly charge the image area whilst preventing toner adherence to the non-image area. That is, the image area on the photosensitive member surface is charged by the scorotron mode while the non-image area is charged by the corotron mode.

To achieve this, the grid should be configured of a regulating portion opposing the image area and at least one non-regulating portion opposing the non-image area. The non-regulating portion should at least oppose the developing area outside the image area, instead of opposing the entire non-image area. In this arrangement, for the image area on the photosensitive member surface, the flow and passage of the particles from the discharge element is regulated by a predetermined voltage so as to be able to supply a stable, uniform flow of particles. The non-regulating portion allows the flow of particles from the discharge element to pass therethrough so as to raise the potential of the developing area outside the image area to equal to or a higher level than the developing potential. Thus, the non-image area can be set at a potential equal to or higher the developing voltage, thus preventing toner adherence in this area.

Further, the arrangement of the non-regulating portions of the grid a predetermined distance away from the photosensitive member makes it possible to prevent the grid set at the predetermined voltage from causing leakage discharge to the low-insulative portions at the photosensitive member edges. In this case, the non-regulating portions can be configured, in a simple manner, by providing openings in the grid. Further, tensioning the grid in the direction away from the photosensitive member prevents the degradation of the flatness of the grid, allowing for stable charging. This manipulation enables the grid to be arranged in proximity to the photosensitive member.

DESCRIPTION OF THE PREFERRED EMBODIMENTS

Figure 1:
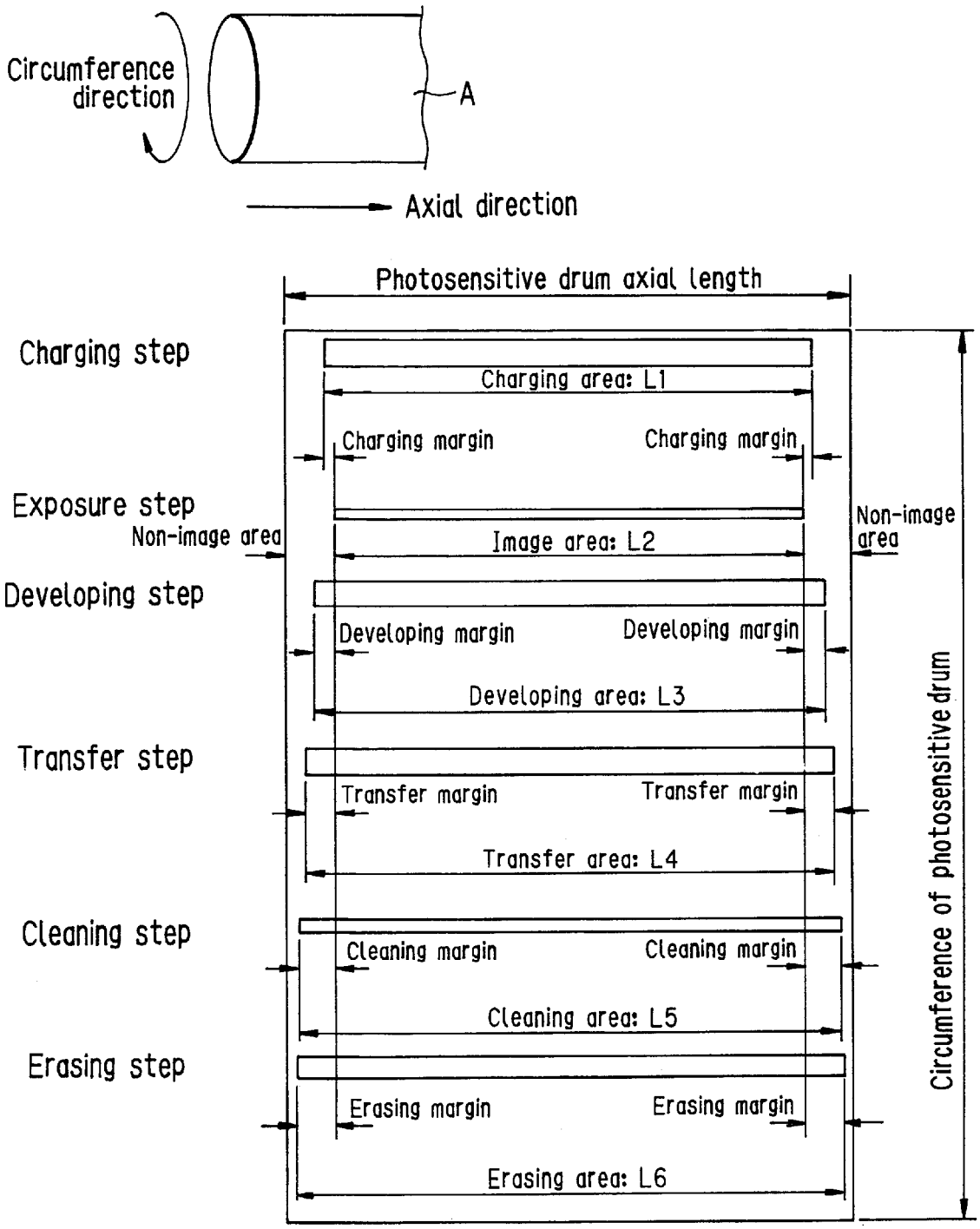
FIG. 1 PRIOR ART
FIG. 1 is a diagram showing the processing areas of different devices across the conventional photosensitive drum surface.

The embodiment of an image forming apparatus according to the present invention will be described with reference to FIG. 3. A digital color copier as the image forming apparatus of the present invention has an original table 111 and a control panel on the top of the copier body and has an image reading portion 110, an image forming portion 210 and a paper feed mechanism 211 within the copier body. A reversing automatic document feeder (RADF) 112 is arranged on the top surface of original table 111 in the predetermined position with respect to the original table 111 surface, whilst being supported so as to be opened and closed relative to original table 111. When this RADF 112 is opened, an original can be directly set on original table 111.

RADF 112, first, conveys an original so that the one side of the original opposes image reading portion 110 at the predetermined position on original table 111. After the image scanning of this side is completed, the original is inverted and conveyed to original table 111 so that the other side opposes image reading portion 110 at the predetermined position on original table 111. Then, when RADF 112 completes image scanning of both sides of one original, the original is discharged and the duplex copy conveying operation for a next document is effected. This operation of the conveyance and face inversion of the original is controlled by a controller incorporated in the copier body in association with the whole copier operation.

Image reading portion 110 is disposed below original table 111 in order to read the image of the original conveyed onto original table 111 by means of RADF 112. Image reading portion 110 includes first and second scanner units 113 and 114 which reciprocate along, and in parallel to, the undersurface of original table 111, an optical lens 115 and a CCD line sensor 116 as a photoelectric converting device.

First scanner unit 113 has an exposure lamp for illuminating the original image surface and a first mirror for deflecting the reflection image of light from the original toward the predetermined direction and moves in a reciprocating manner in parallel with, whilst being kept a certain distance away from, the undersurface of original table 111 at the predetermined speed. Second scanner unit 114 has second and third mirrors which deflect the reflected light image from the original, deflected by first mirror of first scanner unit 113 toward the predetermined direction and moves in a reciprocating manner at a speed related to that of first scanner unit 113 and in parallel thereto.

Optical lens 115 reduces the reflected light image from the original, thus deflected by third mirror of second scanner unit 114, so that the reduced light image will be focused on the predetermined position on CCD line sensor 116.

CCD line sensor 116 photoelectrically converts the focused light image into an electric signal and outputs it. CCD line sensor 116 is a three-line color CCD which can read monochrome and color images and output line data as to color separation components R(red), G(green) and B(blue). The original image information thus obtained as the electric signal from this CCD line sensor 116 is further transferred to an image processor inside the controller where the data is subjected to the predetermined image data processes.

Arranged below image reading portion 110 is image forming portion 210. Provided below image forming portion 210 is a paper feeding mechanism 211 which separates paper P, sheet by sheet, from a stack of paper held in a paper tray 250 and feeds it toward image forming portion 210.

Figure 4:
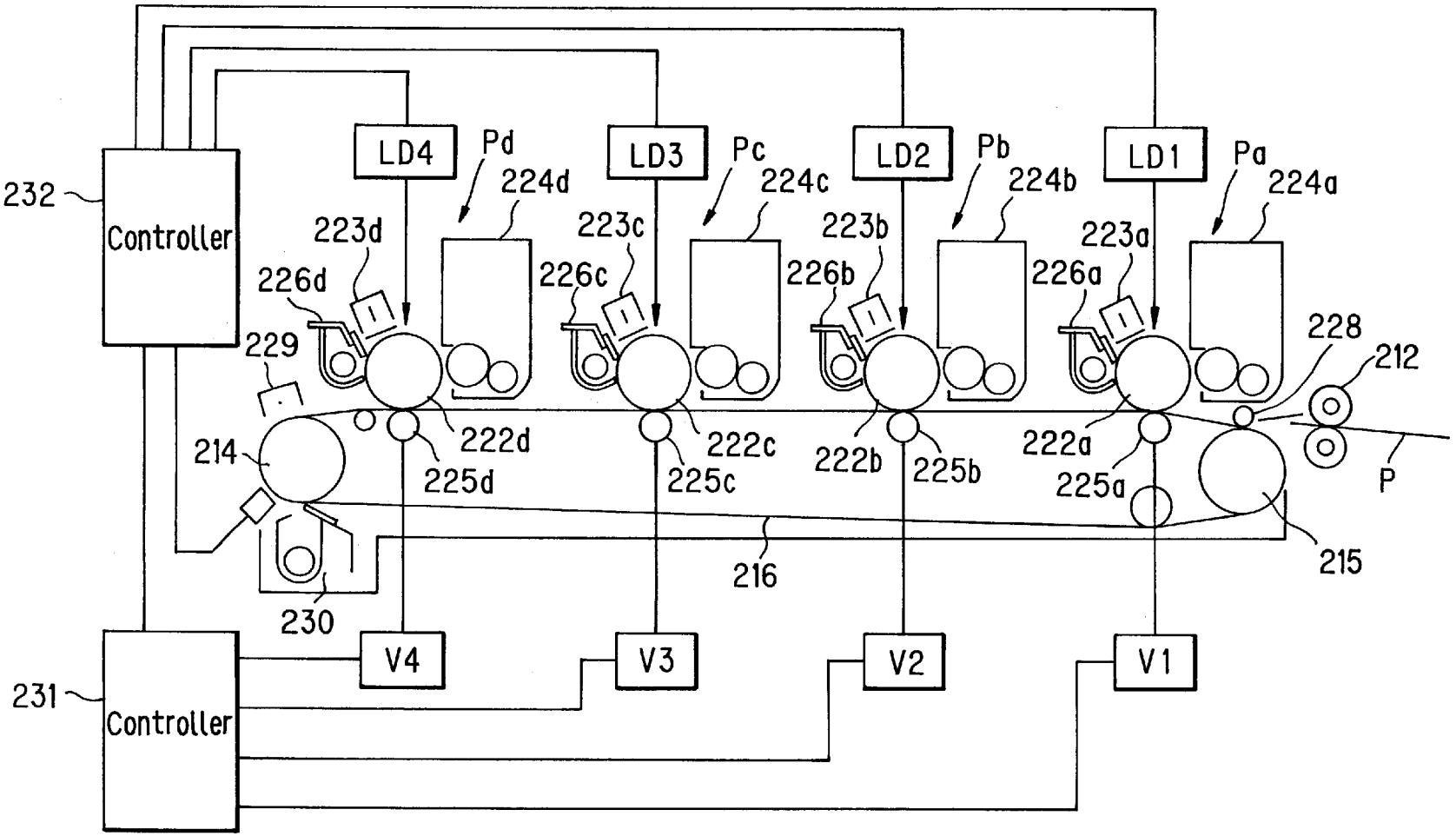
FIG. 4 is a schematic view showing an image forming portion.

As shown in FIG. 4, image forming portion 210 includes: a first image forming station Pa for forming black images; a second image forming station Pb for forming cyan images; a third image forming station Pc for forming magenta images; a fourth image forming station Pa for forming yellow images; laser beam scanner units (LSUs) 227*a* to 227*d* corresponding to respective image forming stations Pa, Pb, Pc and Pd; and a transfer mechanism 213. First image forming station Pa, second image forming station Pb, third image forming station Pc and fourth image forming station Pd are arranged in parallel to each other above and in proximity to transfer mechanism 213, in the above-mentioned order from the upstream side with respect to the paper conveyance direction.

Transfer mechanism 213 is composed of a drive roller 214, an idle roller 215, a conveyance belt 216 wound around and tensioned between the two rollers with the upper and lower belt sections extending substantially in parallel, a paper attraction charger 228 and an erasing device 229. Designated at 230 is a cleaning device for removing the toner and paper dust etc., adhering to conveyance belt 216.

Paper attraction charger 228 is a roller disposed between image forming station Pa and a registration roller 212 and functions to allow paper P to be electrostatically attracted to conveyance transfer belt 216. That is, when paper P is held between conveyance belt 216 and charger 228, a high voltage is applied from charger 228 so that conveyance belt 216 and paper P will attract each other by electrostatic force. Thus, paper P is electrostatically attracted to conveyance belt 216, whereby paper P is prevented from being slid during conveyance.

Erasing device 229 is arranged approximately directly above drive roller 214 located downstream of the fourth image forming station Pd. An alternating current for erasing the charge on the conveyance belt 216 surface is applied to this erasing device 229 so as to separate paper P being electrostatically attracted to conveyance belt 216, from the belt.

Figure 3:
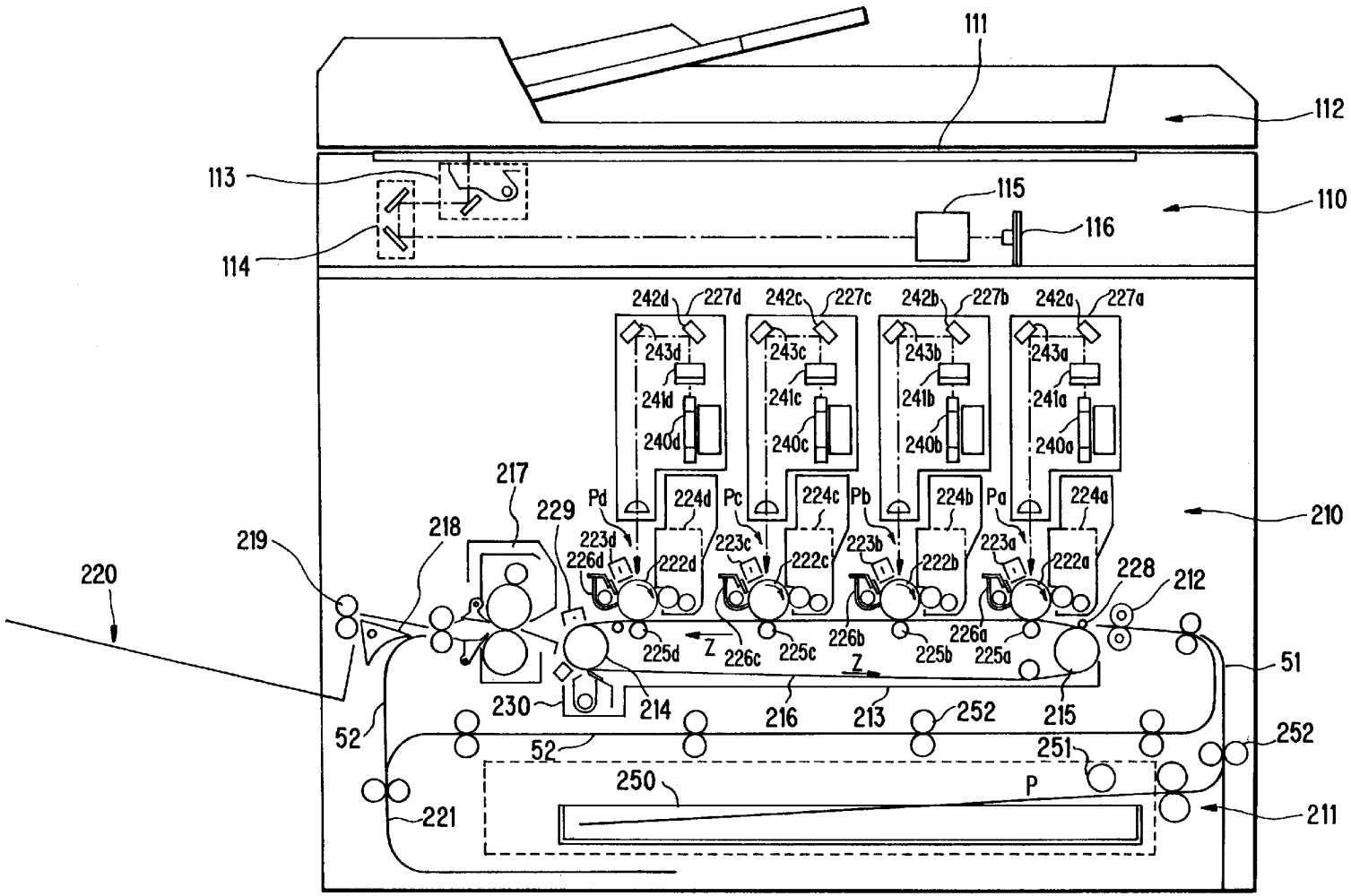
FIG. 3 is a schematic overall view showing a copier of the embodiment of the present invention.

Then, conveyance belt 216 is frictionally driven in the direction of arrow Z in FIG. 3 by means of drive roller 214 and idle roller 215 while conveyance belt 216 is electrified by paper attraction charger 228 so as to electrostatically attract paper P fed by paper feed mechanism 211 and hence convey the paper sequentially along image forming stations Pa to Pd.

Provided on the downstream side of conveyance belt 216 is a fixing unit 217 for fixing the toner image transferred on paper P. This fixing unit 217 has a pair of fixing rollers, and paper P having passed through the nip between the rollers is discharged to the outside of the copier body.

All the image forming stations Pa to Pd are of a substantially identical configuration and have photosensitive drums 222*a* to 222*d*, respectively, which each are driven in the rotational direction indicated by arrow F in FIG. 3. Provided around each photosensitive drum 222*a*–222*d*, are a charging device 223*a*–223*d* for uniformly charging photosensitive drum 222*a*–222*d*, a developing unit 224*a*–224*d* for developing the static latent image formed on photosensitive drum 222*a*–222*d*, a transfer charger 225*a*–225*d* for transferring the toner image on photosensitive drum 222*a*–222*d* to paper P, cleaning unit 226*a*–226*d* for removing the residual toner from photosensitive drum 222*a*–222*d*, in this order with respect to the rotational direction of each photosensitive drum 222*a*–222*d*.

Each photosensitive drum 222*a*–222*d* is of a cylinder coated with a photoconductive, photosensitive layer on the substrate surface thereof and with their ends closed. Further each drum is set so as to be rotationally driven in the direction of arrow F. It should be noted that the photosensitive element can be formed of an endless belt instead of the drum configuration.

Developing units 224*a*, 224*b*, 224*c* and 224*d* hold black toner, cyan toner, magenta toner, yellow toner, respectively. Each developing unit 224*a*–224*d* functions to develop the static latent image on photosensitive drum 222*a*–222*d* by the toner of a corresponding color, forming a toner image.

Each charging device 223*a*–223*d* is of a corona charger of a scorotron type for uniformly charging associated photosensitive drum 222*a*–222*d*. Transfer charger 225*a*–225*d* is a corona charger for transferring the toner image on photosensitive drum 222*a*–222*d* onto paper P. As shown in FIG. 4, in these transfer chargers 225*a*–225*d*, power sources V1–V4 are controlled by a controller 231 which is subordinate to the control unit so as to determine their power (voltages). Further, each cleaning unit 226*a*–226*d* removes the toner that remains on photosensitive drum 222*a*–222*d* after transfer of the toner to paper P.

The length in the axial direction of photosensitive drum 222*a*–222*d* is somewhat greater than the width of paper P. Therefore, the static latent image as well as the toner image (image) is formed not on the entire surface of photosensitive drum 222*a*–222*d* but only on the central area thereof. Here, the image forming area in photosensitive drum 222*a*–222*d* is referred to as image area X and the areas at both ends where no image is formed is referred to as non-image area Y.

Arranged above photosensitive drums 222*a* to 222*d* are laser beam scanner units 227*a*, 227*b*, 227*c* and 227*d*, respectively. Each laser beam scanner unit 227*a*–227*d* includes: a semiconductor laser diode LD1–LD4 as a semiconductor laser device for emitting a spot beam modulated in accordance with an image data stream; a polygon mirror (deflecting device) 240*a*–240*d* for deflecting the laser beam from semiconductor laser diode LD1–LD4, in the main scan direction; an f-theta lens 241*a*–241*d* for focusing the laser beam deflected by polygon mirror 240*a*–240*d* on the surface of photosensitive drum 222*a*–222*d*; and mirrors 242*a*–242*d* and 243*a*–243*d*. The power and the timing of beam emission of semiconductor laser diodes LD1–LD4 are controlled by a controller 232 which is subordinate to the control unit.

The pixel signal corresponding to the black component image of a color original image is supplied to laser beam scanner unit 227*a*; the pixel signal corresponding to the cyan color component image of a color original image is supplied to laser beam scanner unit 227*b*; the pixel signal corresponding to the magenta color component image of a color original image is supplied to laser beam scanner unit 227*c*; and the pixel signal corresponding to the yellow color component image of a color original image is supplied to laser beam scanner unit 227*d*. In this arrangement, the static latent images corresponding to the color separations of the original image information are formed on photosensitive drums 222*a* to 222*d*. The static latent images on photosensitive drums 222*a* to 222*d* are developed by the associated colors of toner through developing units 224*a* to 224*d*. Thus, the color converted, color separations of the original image information by image forming portion 210 are reproduced as toner images of different colors.

Paper feed mechanism 211 conveys paper P to the predetermined positions of image forming portion 210 in order to transfer the color toner images formed by image forming portion 210 to paper P. This mechanism also has the functions, of discharging paper P, after the toner image has been transferred and fixed thereto, to the outside and, of re-circulating the paper P with its one side formed with an image into image forming portion 210 in synchronization with the image forming of image forming portion 210.

Illustratively, paper feed mechanism 211 includes a pickup roller 251 for picking up paper P sheet by sheet from paper tray 250; a plurality of conveyance rollers 252 for conveying paper P through conveyance paths S1 and S2; a registration roller 212, a conveyance direction switching gate 218; paper discharge rollers 219; and a paper output tray 220.

Registration roller 212 briefly stops the paper P having been conveyed by conveyance path S1 and delivers the paper to transfer mechanism 213 in synchronization with image forming stations Pa to Pd so that toner images on photosensitive drums 222*a* to 222*d* can be transferred to paper P correctly.

Actually, the passage of paper P being conveyed along conveyance path S1 through the predetermined position is detected by a detecting switch located before registration. Based on the detection signal output at this timing, registration roller 212 is driven to deliver paper P to transfer mechanism 213 with a timing such that the leading edges of the toner images on photosensitive drums 222*a* to 222*d* will be abutted on the leading end of the printing range on paper P.

Switching gate 218 selectively connects the conveyance path of paper P after fixing with either the discharge path to discharge paper P to the outside of the copier body or auxiliary path S2 to recirculate paper P toward image forming portion 210. The paper P which is designated to be conveyed again to image forming portion 210 by means of switching gate 218 is face-inverted by means of a switchback conveyance path 221 and then re-fed to image forming portion 210 through auxiliary path S2.

In the thus configured digital color copier, the control unit controls paper conveyance in timing with the image forming process. Cut-sheet type paper is used as paper P. When paper P is delivered from paper tray 250 to paper conveyance path S1, the leading edge of paper P is detected by a sensor located before registration, which outputs a detection signal, based on which registration roller 212 briefly stops the paper.

Then, paper P is delivered in synchronization with image forming of image forming stations Pa to Pd, onto conveyance belt 216 that is rotating in the direction of arrow Z. Meanwhile, conveyance belt 216 has been charged in a predetermined manner by paper attraction charger 228 as stated above, so that paper P is positively attracted to conveyance belt 216 and stably conveyed without any misregistration through the passage of all the image forming stations Pa to Pd.

In each image forming station Pa to Pd, the toner image of each color is formed on the photosensitive drum 222*a*–222*d* so that the different color images are superimposed on the surface of paper P which is conveyed whilst being electrostatically attracted by conveyance belt 216. When transfer of the image formed by the fourth image forming station Pd is completed, paper P is separated by virtue of erasing device 229, in a continuous manner starting at its leading edge, from conveyance belt 216 and introduced into fixing unit 217. Finally, paper P having passed through the nip between a pair of fixing rollers in fixing unit 217 passes through conveyance direction switching gate 218 and is discharged by discharge rollers 219 onto paper output tray 220 attached to the outside wall of the copier body.

In the above configuration, writing to the photosensitive drums 222*a*–222*d* is performed by laser beam scanning exposure using laser beam scanner units 227*a* to 227*d*. However, instead of the laser beam scanner units, another optical writing system (LED head) made up of a light emitting diode array with a focusing lens array may be used. An LED head is smaller in size compared to a laser beam scanner unit and has no moving parts hence is silent. Therefore, this LED head can be preferably used for image forming apparatus such as digital color copiers of a tandem arrangement type needing multiple optical writing units.

Figure 5:
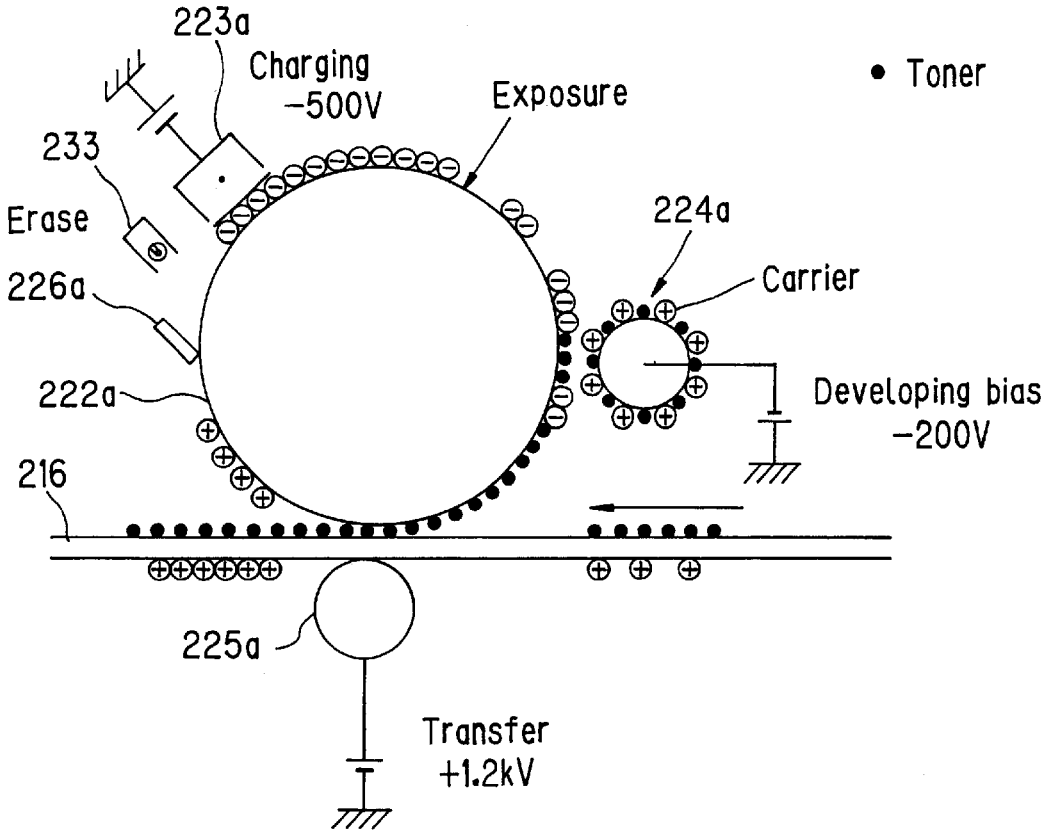
FIG. 5 is a view for illustrating a series of image forming processing steps.
Figure 6:
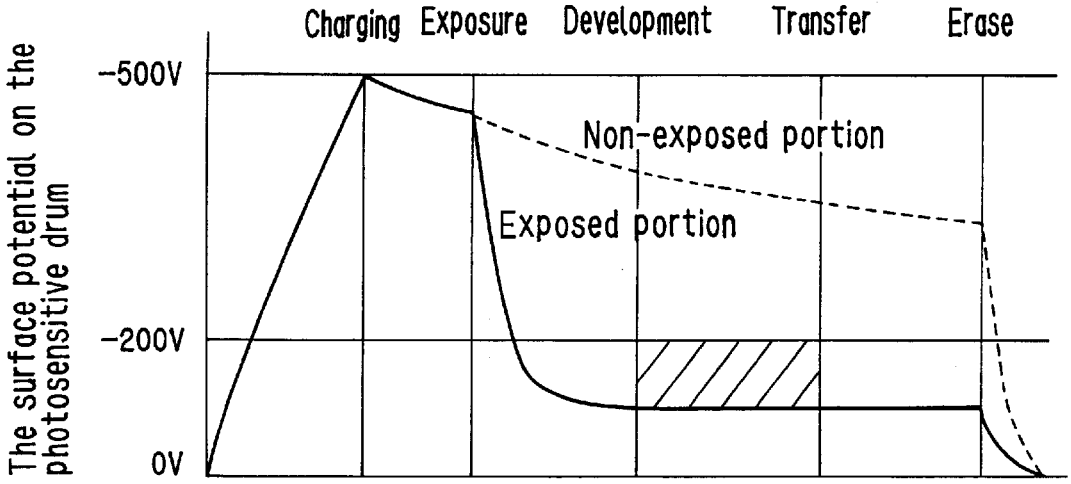
FIG. 6 is a chart showing the evolution of the surface potential on a photosensitive drum.

Next, the image forming process in image forming stations Pa to Pd will be briefly described. These image forming stations Pa to Pd have an identical configuration, so that description hereinbelow will be made only on image forming station Pa. FIG. 5 is an illustrative view showing the vicinity of photosensitive drum 222*a* in image forming station Pa. FIG. 6 shows the evolution of the surface potential on photosensitive drum 222*a* with the proceedings of the steps involved.

As shown in the figures, the surface of photosensitive drum 222*a* is charged uniformly with the same polarity as the toner, at −500 V, by charging device 223*a* in preparation for toner image forming. Then, the surface, specifically the image area X is exposed to light by laser beam scanner unit 227*a*. This exposure forms a static latent image corresponding to the black image on the surface within the image area X on photosensitive drum 222*a*.

The potential levels in the static latent image made up of the areas that have been exposed to light range from about −100 V to some tens of volts, though differing depending upon the method of exposure. For example, in the case shown in FIG. 6, the level is about −100 V, which is lower than −200 V, the developing bias voltage as indicated by the hatch in the chart. Accordingly, the toner of developing unit 224*a* which has a bias voltage of −200 V applied thereto is attracted to the static latent image in the image area X on photosensitive drum 222*a* forming a toner image. In contrast, a non-exposed area where no exposure is made in the image area X spontaneously loses its charge (surface potential) given by charging device 223*a*, but still has a voltage of about −400 V when it is developed. As a result, the toner of developing unit 224*a* will not become attracted to the non-exposed area.

Transfer charger 225*a* is applied with a voltage of +1.2 kV. This electric power causes corona discharge so that the transfer charger will give positive charge, which is opposite to the polarity of the toner, to paper P on conveyance belt 216. Accordingly, above transfer charger 225*a*, the toner image on photosensitive drum 222*a* is electrostatically attracted to and transferred to paper P.

Thereafter, the residual toner is removed from photosensitive drum 222*a* by means of cleaning unit 226*a*, and then the charge on the drum surface is erased by erasing device 233, whereby both the surface potentials at the light exposed area and non-exposed area reach zero.

Figure 7:
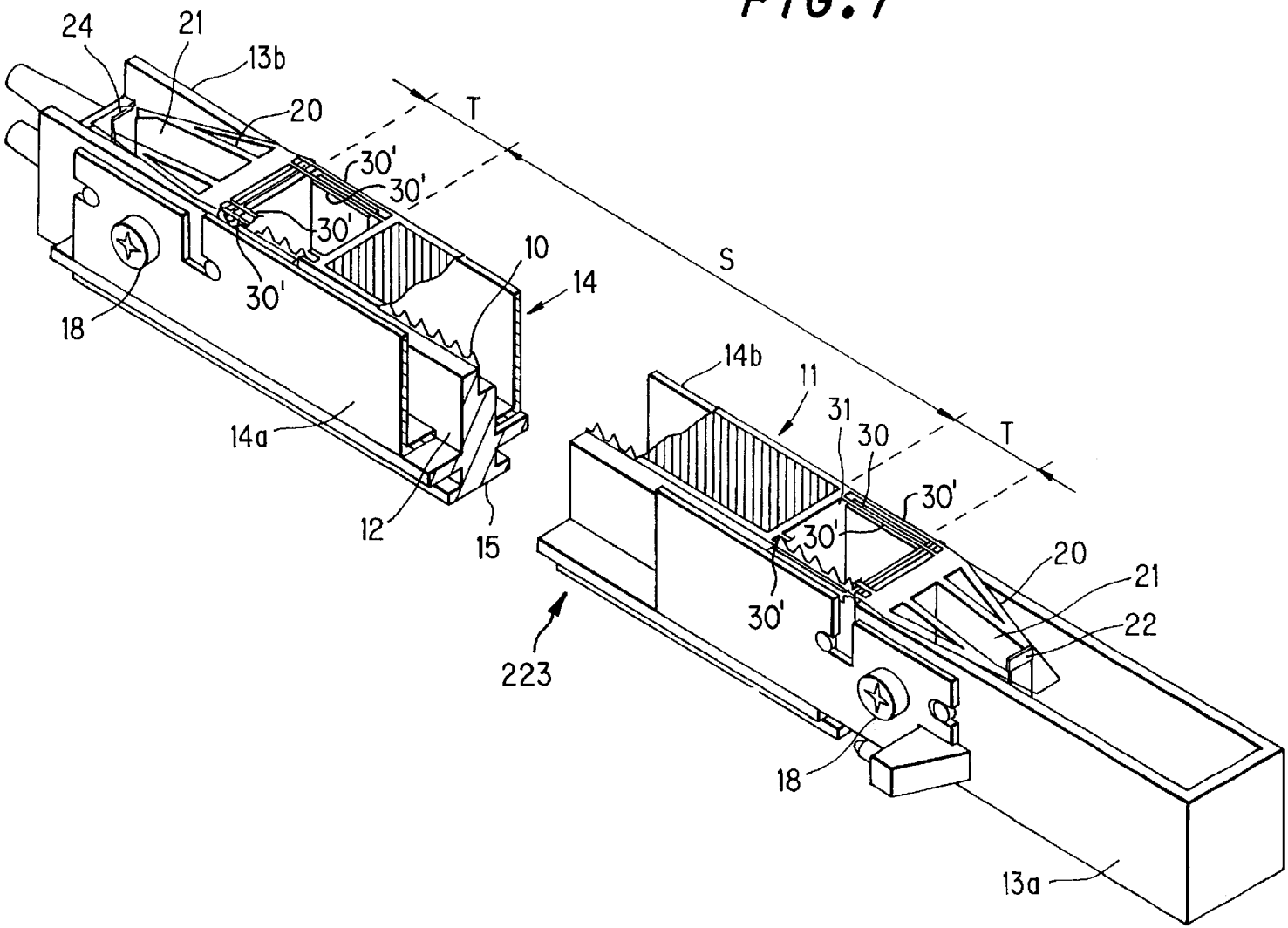
FIG. 7 is a broken and partially cutaway perspective view showing a charging device.
Figure 8:
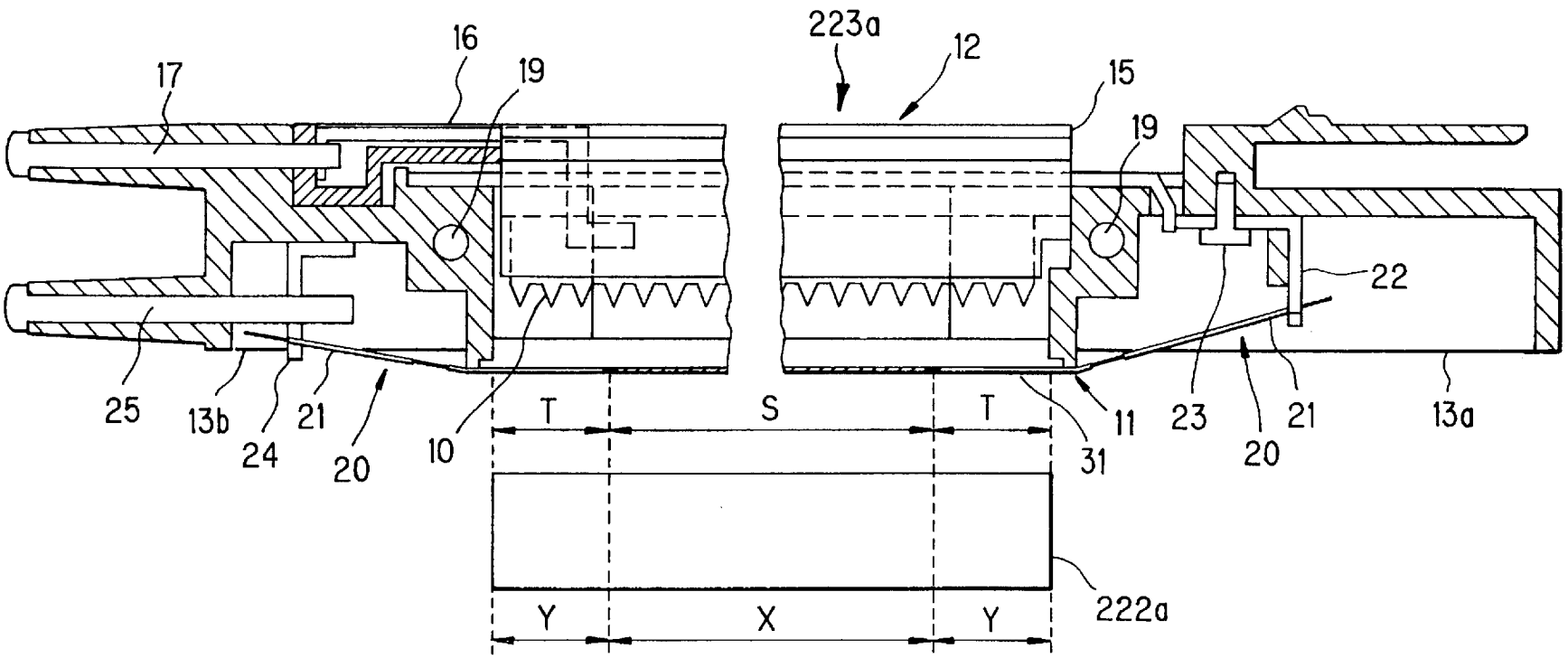
FIG. 8 is a sectional view showing a charging device.

Next, detailed configurations of charging devices 223*a* to 223*d* which feature the copier of the present embodiment will be described with reference to FIGS. 7 and 8. Here, since these charging devices 223*a* to 223*d* have an identical structure, the description will be made on only the charging device 223*a* in image forming station Pa.

Charging device 223*a*, as it causes charged particles (corona ions) to be radiated by corona discharge from a discharge element 10 toward photosensitive drum 222*a*, supplies electric charge and electrifies the photosensitive drum 222*a* surface uniformly by the function of a grid 11. For this purpose, charging device 223*a* is composed of discharge element 10, an electrode holder 12 for holding this discharge element 10, grid 11, front and rear holders 13*a* and 13*b* for holding grid 11 and a charger case 14 enclosing the left and right ends of discharge element 10.

Discharge element 10 is an electrode made up of a stainless steel blade having a serrated edge to cause corona discharge and is attached to electrode holder 12 made up of an insulative material such as polycarbonate, etc. Electrode holder 12 is a base for holding discharge element 10 and also functions to fix charging device 223*a* to the copier body. That is, an insertion guide 15 is formed in the bottom part of electrode holder 12. This insertion guide 15 is fitted into an unillustrated, rail-like engaging portion in the copier body so that charging device 223*a* is fixed to the predetermined position in the copier body.

Figure 9:
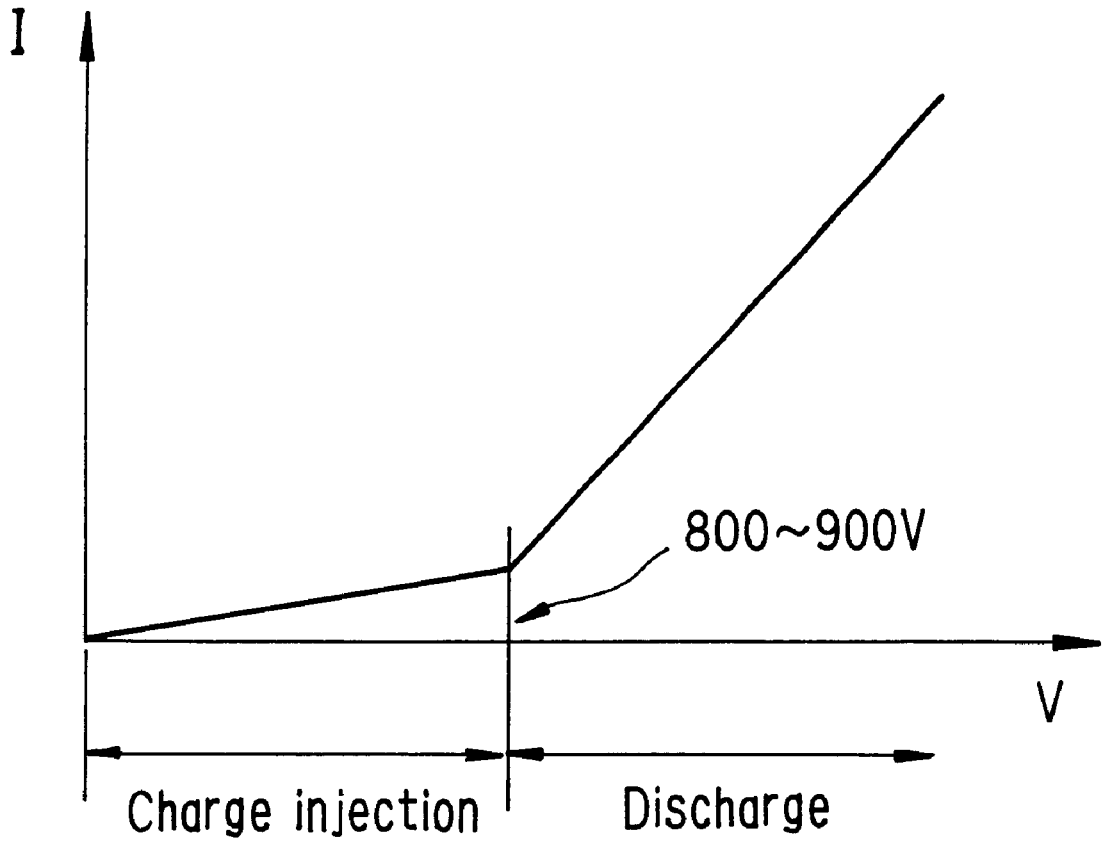
FIG. 9 is a chart showing the relationship between the applied voltage to a discharge element and the generated current.

The end portion on the rear side of discharge element 10 is connected to an intermediary electrode 16 which in turn is connected to an electrode screw 17. This electrode screw 17 is screwed to rear holder 13*b*. FIG. 9 shows a relationship between the voltage applied to discharge element 10 from an external power source by way of electrode screw 17 and the current flowing through discharge element 10. As shown in this chart, as the applied voltage exceeds 800 to 900 V, the current passing through discharge element 10 is found to increase with the slope (change in current/change in voltage) changing discontinuously. This means that discharge element 10 will start discharge when a voltage of 800–900 V or greater is applied thereto.

Charger case 14 is composed of a first casing 14*a* and a second casing 14*b*. These elements are arranged opposite to each other with electrode holder 12 in between, functioning opposing electrodes of discharge element 10. Each of casings 14*a* and 14*b* has screw holes at both ends thereof. A pair of fixing screws 18 bind and fix the two casings 14*a* and 14*b* together by their passing through passage holes 19 formed in holders 13*a* and 13*b* and being screwed to these screw holes.

Grid 11 is disposed between discharge element 10 and photosensitive drum 222*a*. The voltage applied to the grid controls the corona ion flow as the particle flow arising from discharge element 10 to thereby adjust the amount of ions reaching the photosensitive drum 222*a* surface. This grid is a thin plate which is made up of stainless steel or tungsten and formed into a mesh structure by an etching process.

This grid 11 has electrode portions 20 at both ends to be held by front and rear holders 13*a* and 13*b* so that the grid can be connected to an external power source. Electrode portion 20 has an engagement hole 21 formed therein. An L-shaped grid-tensioning electrode 22 that engages this engagement hole 21 is provided for front holder 13*a*. This grid-tensioning electrode 22 is fixed to front holder 13*a* by means of a fixing screw 23. Arranged in rear holder 13*b* is an L-shaped grid-tensioning electrode 24 that engages corresponding engagement hole 21. Grid-tensioning electrode 24 is coupled to an electrode screw 25 (FIG. 8) which is screw fixed to rear holder 13*b*. Electrode screw 25 is connected to an external power source so that a voltage is applied to electrode portion 20 of grid 11 by way of grid tensioning electrode 24.

In the above way, grid 11 is held as it is drawn inwardly in the direction away from photosensitive drum 222*a* with electrode portions 20 at both ends engaged by hook-shaped electrodes 22 and 24. Grid tensioning electrode 24 is adapted to move in the longitudinal direction of grid 11. Therefore, when the user fastens or loosens electrode screw 25 so as to move the position of grid tensioning electrode 24, the distance between two electrodes 22 and 24 varies enabling adjustment of the tension applied on grid 11. Accordingly, holding and adjustment on the tension of grid 11 can be carried out with a simple mechanism, and the easy tension adjustment leads to stabilized charging.

The central part of grid 11 opposes discharge element 10 and photosensitive drum 222*a*. Here, the range of the grid opposing the image area X on photosensitive drum 222*a* forms a regulating portion S while the range opposing the non-image area Y forms non-regulating portions T.

Regulating portion S has a mesh configuration and is positioned in the course of the flow of ions as the particles discharged from discharge element 10 to the image area X on photosensitive drum 222*a*. Therefore, regulating portion S forms a scorotron zone which functions to make the flow density of ions passing therethrough even to thereby make uniform the amount of ions supplied to the image area X on photosensitive drum 222*a*.

Non-regulating portions T are located at both sides of regulating portion S. Each non-regulating portion T has an opening 31 enclosed by a four-sided frame 30, so the ions emitted from discharge element 10 pass through openings 31 and directly irradiate the non-image area Y on photosensitive drum 222*a*. Accordingly, since the ion flow from discharge element 10 reaches the photosensitive drum 222*a* surface in the non-image area Y without being shaded, non-regulating portions T form a so-called corotron zone. Here, each of left and right sides of frame 30 with respect to the longitudinal direction has two wires 30' (FIG. 7). This aims at increasing the opening area whilst maintaining the strength of grid 11. Further, these wires of frame 30 are formed at positions close to the sides with respect to the longitudinal axis so that they can be kept as far away from photosensitive drum 222*a* as possible.

In the above way, charging device 223*a* is configured so that the ion flow controlled by regulating portion S is radiated over the image area X on photosensitive drum 222*a* while the ion flow generated from discharge element 10 directly reaches the non-image area Y. As a result, more ions reach the non-image areas Y than the image area X, so that the non-image area Y will have greater potential variations than the image area X.

Figure 2:
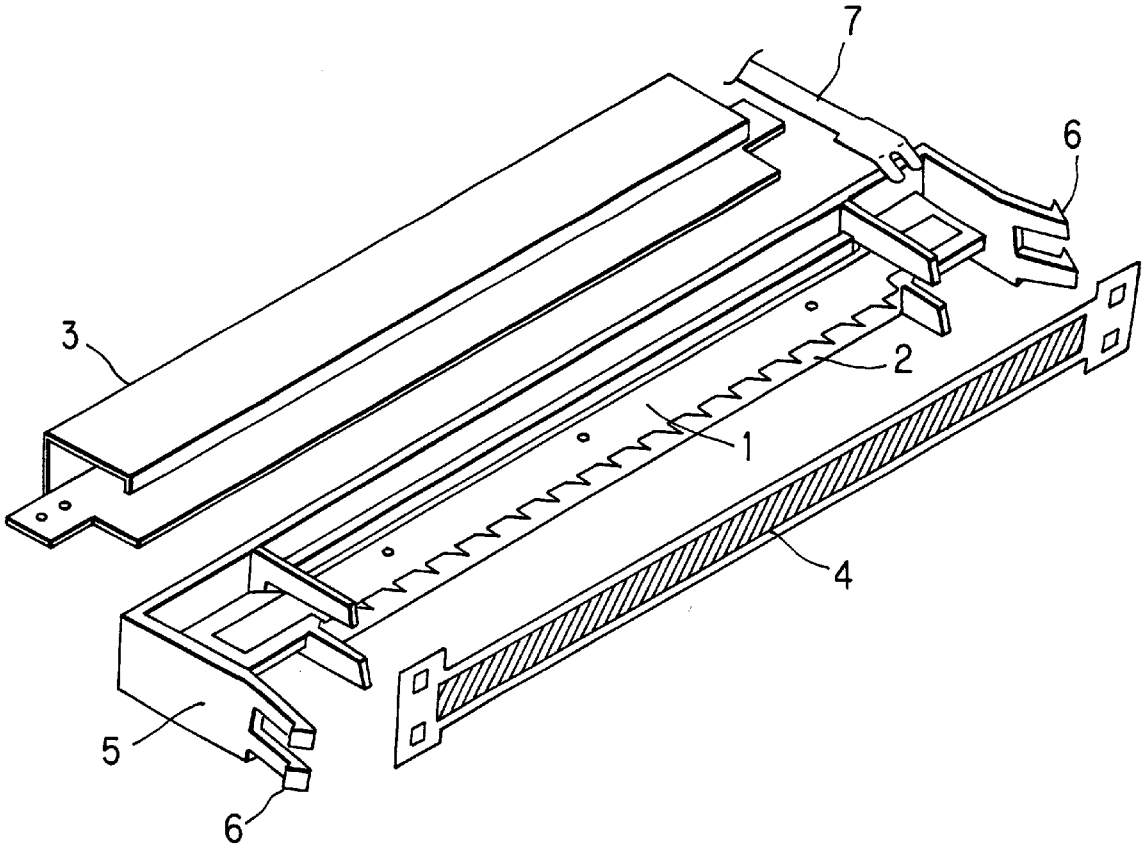
FIG. 2 PRIOR ART
FIG. 2 is an exploded perspective view showing a conventional charging device.
Figure 10:
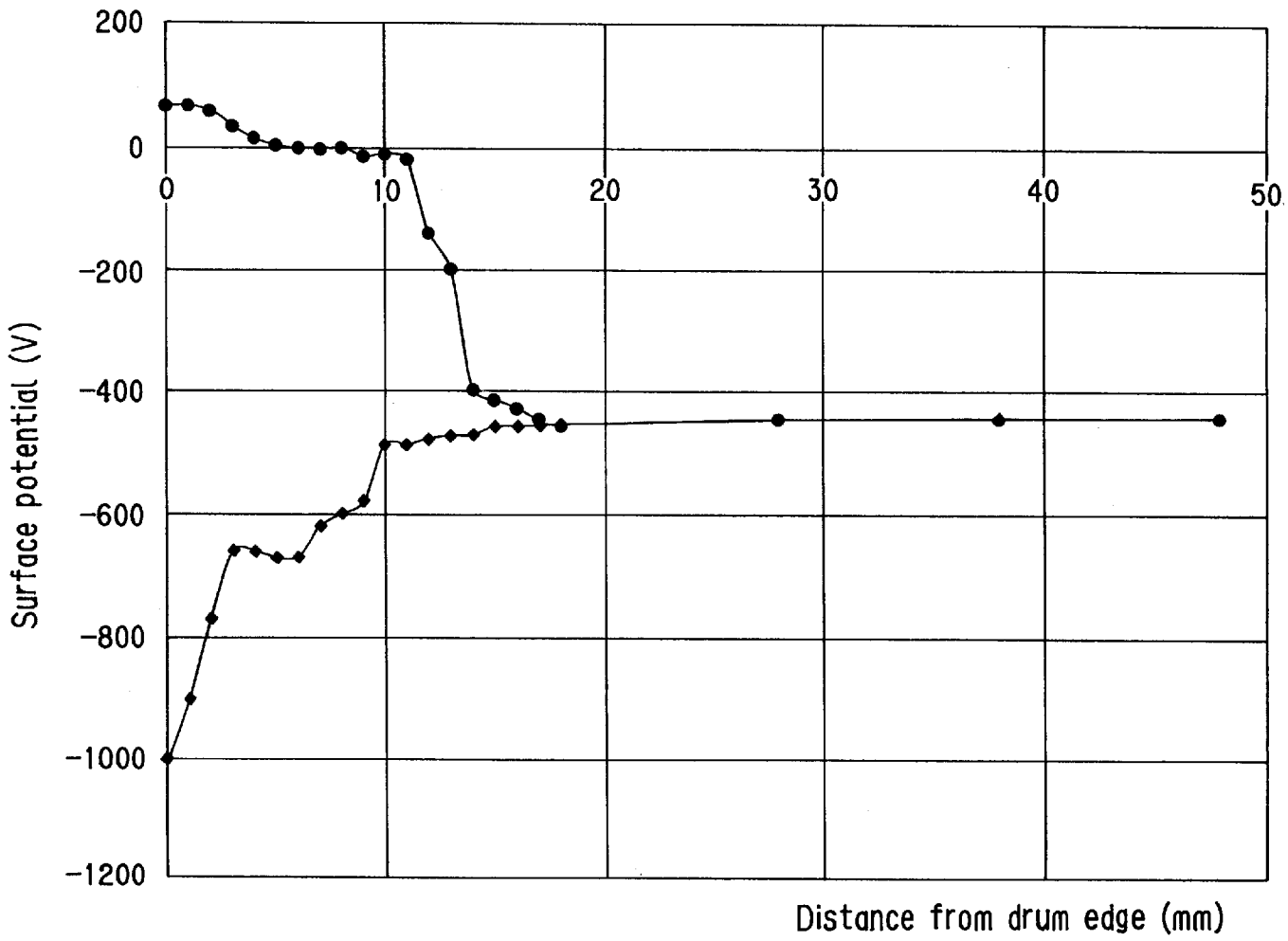
FIG. 10 is a chart showing the charging distribution characteristic of a charging device of the present invention and that of a conventional charging device.

Now, the surface potential on photosensitive drum 222*a* charged by charging device 223*a* of the present invention and the surface potential on the same drum charged by the conventional charging device shown in FIG. 2 will be compared. As shown in FIG. 10, when the conventional charging device is used, photosensitive drum 222*a* has surface potentials nearly equal to 0 V around the edge, i.e., the non-image area Y thereof, as indicated by ● in the chart. In contrast, when charging device 223*a* of the present invention is used, the potential in the non-image area Y is higher (in absolute value) than −600 V which is the potential of the image area X, as indicated by ♦ in the chart. Here, in this description, the magnitude of the potential is compared based on the absolute value. It should be understood that a higher potential means a potential of a greater absolute value.

Accordingly, when the conventional charging device is used, the toner will adhere to the non-image area Y where the potential is lower than −200 V which is the developing bias voltage of developing unit 224*a*, upon the development by developing unit 224*a*, causing pollution of paper P and the copier interior and promoting toner waste. In contrast, when charging device 223*a* is used, since the non-image area Y has a potential of −200 V or higher, no toner will adhere to the non-image area Y. Therefore, it is possible to avoid pollution by the toner as well as toner waste.

In the above way, prevention against the adherence of the toner to the non-image area Y on photosensitive drum 222*a* can be attained by setting the surface potential of photosensitive drum 222*a* at least higher than the developing bias voltage. Therefore, instead of forming the openings, the grid in the non-regulating portions T may be formed with a rough mesh so as to increase the ion flow passable therethrough. That is, the grid mesh size should be set so that the surface potential in the areas on photosensitive drum 222*a* will be set higher than the developing bias voltage. This facilitates a single step operation to produce a mesh grid if an etching process is used for mesh forming.

Grid 11 is formed linearly in parallel with photosensitive drum 222*a* other than electrode portions 20 while electrodes 22 and 24 as the hooks engaging the electrode portions 20 for tensioning grid 11 are provided so as to project toward photosensitive drum 222*a*. This tensioning arrangement of grid 11 makes it possible to reduce the length of charging device 223*a* compared to the configuration in which hooks are formed on the charger case side, i.e., at both ends of the charging device.

This reduction in length removes shape and geometric constraints of charging device 223*a* with the other components arranged around photosensitive drum 222*a*, such as developing unit 224*a*, erasing device 233 etc. Further, even when photosensitive drum 222*a* is very small and other components are arranged in close proximity to charging device 223*a*, there is no need to remove the other components when charging device 223*a* is attached or removed. Thus, this design of charging device 223*a* with grid 11 can avoid increase in its manufacturing cost and design cost due to provided with grid 11.

In order to simplify manufacturing of photosensitive drums, photosensitive drum 222*a* may be produced, in some cases, in a manner that the conductive substrate of the photosensitive drum 222*a* made up of an aluminum alloy or conductive resin etc., is exposed at axial edges thereof corresponding to the non-image area Y, by leaving uncoated parts. In other cases, in order to remove the pooling of the application liquid at the photosensitive drum edges, excessive application of the liquid is wiped off after the application of the photosensitive layer. Thus, such photosensitive drums, even they have the photosensitive layer, present lower electric insulation at the edges than that in other portions. When such a photosensitive drum 222*a* is charged using a conventional scorotron type charging device, leakage discharge (lightening strike) occurs from grid 11 to the exposed substrate portions or the low-insulative portions where the application liquid was wiped off, thus giving rise to a problem of photosensitive drum 222*a* being damaged. In some cases, the resin-made flanges assembled at the ends of photosensitive drum 222*a* may be made conductive to electrically ground the conductive substrate. This configuration also suffers from the same leakage discharge from grid 11. Further, there is another problem occurring in a configuration in which insulative resin-made flanges are assembled at the ends of photosensitive drum 222*a*. The insulative resin-made flanges may be tribo-electrified by friction contact with seal elements (side seal elements) provided for sealing both axial ends of the opening of cleaning unit 226*a*. In this case, if the flanges, due to the tribo-electrification, come to bear a polarity of charge opposite to that of the toner, the tribo-electrified portions in the flanges attract the toner from developing unit 224*a* and the scattering toner around photosensitive drum 222*a* and comes to rub the seal elements, polluting them.

Figure 11:
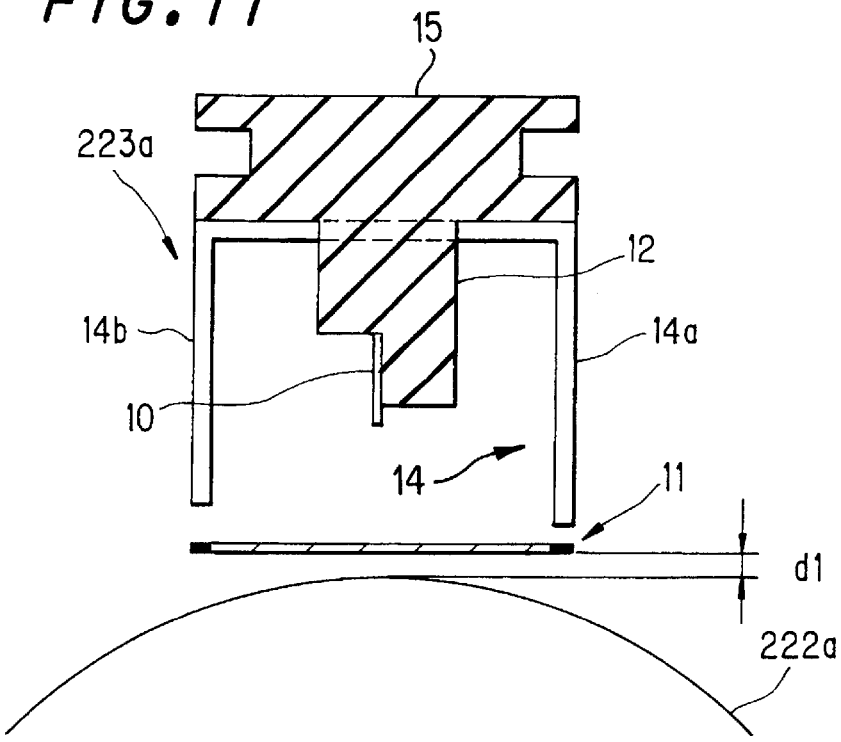
FIG. 11 is a view showing the positional relationship between the photosensitive drum and the regulating portion of a charging device.
Figure 12:
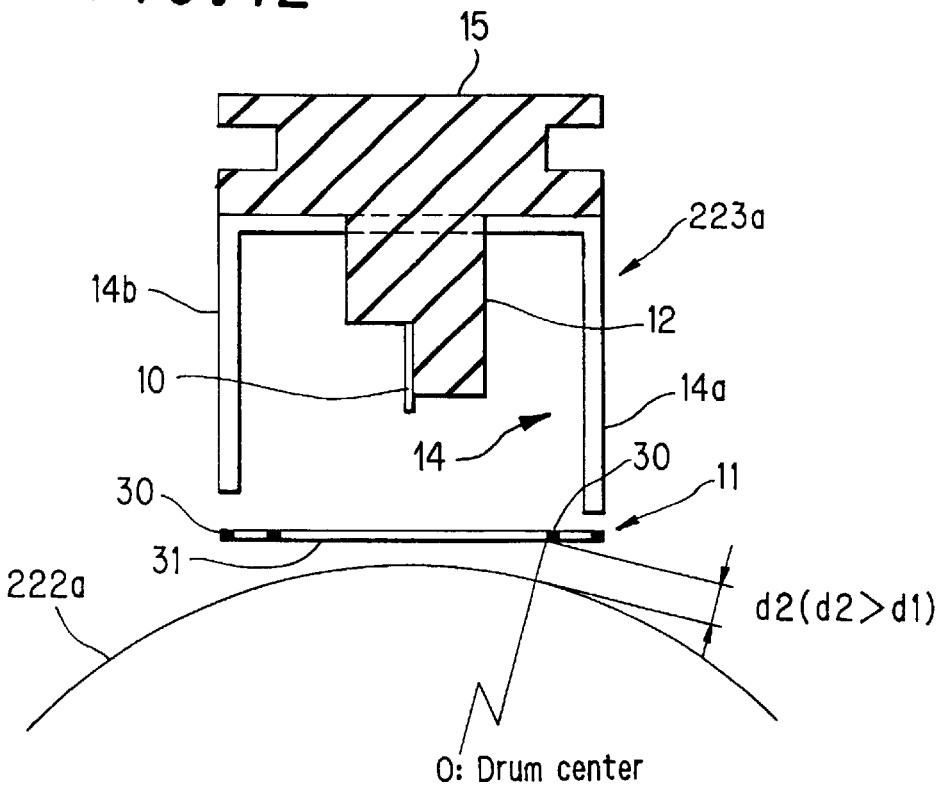
FIG. 12 is a view showing the positional relationship between the photosensitive drum and the non-regulating portion of a charging device.

Charging device 223*a* having non-regulating portions T makes it possible to avoid the above leakage discharge. That is, as shown in FIG. 11, the least distance between regulating portion S and photosensitive drum 222*a* is the distance, designated by d1 (0.8 to 1.0 mm), from the center of regulating portion S to the surface of photosensitive drum 222*a*. On the other hand, as shown in FIG. 12, the least distance between the non-regulating portion T and photosensitive drum 222*a* is the distance, designated by d2, from the frame 30 to the surface of photosensitive drum 222*a*, which is greater than the distance d1. In this way, since the distance from charging device 223*a* to photosensitive drum 222*a* is greater in the non-image area Y, no leakage discharge from grid 11 will occur even if there are some low-insulative portions as above. As a result, it is possible to prevent damage to photosensitive drum 222*a*, charging device 223*a* and other components therearound. Since the axial end portions of photosensitive drum 222*a* are electrified with the same polarity as the toner, no toner will adhere to the insulative flanges as above and hence no pollution of the seal elements in cleaning unit 226*a* will occur. Further, since leakage discharge to the low insulative portions at the photosensitive drum edges can be prevented, this allows the low-insulative portions to be arranged closer to the center of the photosensitive drum, thus making it possible to reduce the axial length of the photosensitive drum and hence make it compact.

It is to be understood that the present invention is not limited to the above embodiment, but various changes and modifications may be made in the above embodiment without departing from the scope of the present invention. For example, a charging device may be configured by combining different types of chargers. Specifically, a first charger portion of a scorotron type may be provided opposing the image area on the photosensitive drum and a second charger portion of a corotron type may be provided opposing the non-image area. In this case, since charging by the second charger portion is to prevent toner adherence, the surface potential in the non-image area is high enough if it is greater than the developing bias voltage. Therefore, the second charger portion may and should be applied with a voltage lower than that applied to the first charger portion, thus it is possible to reduce the total power consumption.

In the above embodiment, two non-regulating portions T are provided. According to the present invention, the number of non-regulating portion T is corresponding to that of the developing area outside the image area. Thus, the number of non-regulating portion is not limited to two, but may be at least one.

In the above embodiment, openings are arranged in the grid at the positions opposing the entire non-image area on the photosensitive drum, in other words, the areas outside the image area within the developing area up to the low-insulative on the photosensitive drum edges, in order to prevent toner adherence to the developing area outside the image area as well as to prevent leakage discharge to the low-insulative portions at the photosensitive drum edges. Instead, the regulating portion of the grid may be extended opposing the developing area outside the image area while openings may be arranged opposing the low-insulative portions at the photosensitive drum edges only, so that this developing area will be charged at a potential of the same polarity and higher in absolute value than the developing bias voltage, whereby it is possible to prevent toner adherence to this developing area. Alternatively, the regulating portion of the grid may be extended outward a predetermined distance beyond the boundaries of the image area for allowing a charging margin so as to charge the image area stably and uniformly while no grid may be formed for the portions other than the regulating portion. That is, the grid need not be extended to cover all of the part of the non-image area and the low-insulative portions at the photosensitive drum edges.

In the above embodiment, the grid starts to separate from the photosensitive drum surface from the outside of the edge of the discharge element. However, the regulating portion of the grid may be extended outward a predetermined distance beyond the boundaries of the image area for allowing a charging margin so as to charge the image area stably and uniformly, and from there the grid may start to separate away from the photosensitive drum surface. In this case, the developing area outside the image area and the other non-image areas should be charged at a voltage of the same polarity as, and greater in absolute value than, the developing bias voltage. In this case, it is also possible to charge the image area stably and uniformly and hence produce images of a good quality while the developing area outside the image area and the other non-image area are charged at a voltage of the same polarity as, and greater in absolute value than, the developing bias voltage, whereby it is possible to reduce the waste toner consumption and hence prevent the reduction of the life of the waste toner container and prevent early degradation of the sealing performance of the seal elements in the cleaning unit. Besides, it is also possible to prevent leakage discharge to the low-insulative portions at the photosensitive drum edges. Therefore, this allows the low-insulative portions to be arranged closer to the center of the photosensitive drum, thus making it possible to reduce the axial length of the photosensitive drum and hence make it compact. Also with the above variations, the discharge element is of course formed so as to be able to charge the entire non-image area.

As has been apparent from the description heretofore, according to the present invention, it is possible to stably and uniformly supply electric charge in the form of corona ions etc., from the discharge element to the image area on the photosensitive member, so that stable charging is obtained resulting in formation of improved images. On the other hand, a sufficiency of electric charge can be supplied from the discharge element to the non-image area on the photosensitive member so as to set that area at a surface potential equal to or higher than the developing potential. Thus it is possible to prevent toner adhesion. In this way, provision of a charging device by the suitable combination of scorotron and corotron modes ensures high quality image formation while reducing waste toner consumption and hence lengthening the life of the waster toner container. Further, because of no toner adherence and hence no cleaning therefor, the seal elements in the cleaning unit will receive no extra load, so that it is possible to keep the sealing performance over a prolonged period of time.

When the grid is configured of a regulating portion opposing the image area and non-regulating portions opposing the non-image area, the non-regulating portions are arranged a predetermined distance away from the photosensitive member. This arrangement prevents leakage discharge from the non-regulating portions of the grid to the low-insulative portions at the photosensitive member edges and hence prevents damage to the photosensitive layer of the photosensitive member.

Since the grid can be tensioned without losing the flatness by drawing it in the direction away from the photosensitive member, it is possible to stably charge the photosensitive member surface at a uniform surface potential across the image area. Further, since it is possible to arrange the grid closer to the photosensitive member surface, the voltage to be applied to the discharge element can be lowered, whereby it is possible to use a compact type high-voltage application transformer etc. Moreover, since no leakage discharge will occur if the low-insulative portions at the photosensitive member edges are arranged closer to the center, the axial length of the photosensitive member can be shortened, leading to miniaturization of each unit and allowing the components around the photosensitive member to be attached and removed in an easy way.

What is claimed is:

1. A charging device for charging a photosensitive member surface on which a toner is supplied to create a toner image, with the same polarity as that of the toner, comprising:

a first charger portion of a scorotron mode having an opening of a predetermined size, and including a grid element thereon for charging the image area on the photosensitive member surface, on which the toner image is formed; and a second charger portion of a corotron mode having a single non-obstructed opening therein and having a size less than the opening of the first charger portion for charging the non-image area of the photosensitive member surface where said single non-obstructed opening is located beyond the physical longitudinal extent of the grid.

2. The charging device according to claim 1 wherein said first charger portion comprises an elongated intermediate charger portion, and said second charger portion comprises a pair of outer charger portions, each of said outer charger portions having a respective single non-obstructed opening located in proximity to opposite edges of the photosensitive member surface.

3. The charging device according to claim 2 wherein said pair of outer charger portions and said intermediate charger portion comprise a unitary structure mounted in a charger case.

4. The charging device according to claim 3 wherein said pair of outer charger portions each comprise a four sided frame defining the respective single non-obstructed opening therein.

5. The charging device according to claim 4 and additionally including tensioning means located on the outer charger portions for applying tension to each end of the unitary structure.

6. The charging device according to claim 5 wherein said tensioning means includes respective angulated electrode members extending outwardly and inwardly from said outer charge portions to grid tensioning electrode members, one of which is fixed and the other of which is adjustably movable.

7. The charging device according to claim 3 and additionally including a single elongated charged particle discharge element extending lengthwise in said charger case beneath the grid element of the intermediate charger portion and traversing the single openings of said outer charger portions.

8. The charging device according to claim 7 where said discharge element includes an elongated blade having a serrated charged particle generating edge.

9. The charging device according to claim 8 wherein said discharge element is mounted on an elongated electrode holder slidably insertable in said charger case.

10. The charging device according to claim 4 and additionally including one or more grid strengthening wires extending adjacent and substantially parallel to opposing outer side walls of the frame, said one or more wires being positioned so as to provide substantially no obstruction to the non-obstructed opening.

11. The charging device according to claim 10 wherein said one or more grid strengthening wires comprise a pair of grid strengthening wires located adjacent both said outer side walls of the frame and extending between a mesh portion of the grid element and an outer end member.

12. The charging device according to claim 2 and additionally including at least one wire extending along mutually opposing outer walls of the non-obstructed opening between the grid element and to an outer end member for improving the strength of the grid while providing substantially no obstruction to said non-obstructed opening.

13. The charging device according to claim 1, wherein the grid elements of the first charger portion is located at a first distance from the photosensitive member surface, and an element located beyond the single non-obstructed opening is located from the photosensitive member by a second distance which is greater than the first distance.

14. A charging device for charging a photosensitive member surface on which a toner is supplied to create a toner image, with the same polarity as that of the toner, comprising:

a discharge element for generating charged particles to supply static charge on the photosensitive member surface;

a grid composed of a regulating portion which is disposed opposing the image area, on the photosensitive member surface, on which the toner image is formed, and has a predetermined voltage applied so as to regulate and make uniform the flow and passage of the particles from the discharge element toward the image area and at least one non-regulating portion which at least opposes the developing area residing outside the image area on the photosensitive member surface, wherein the non-regulating portion includes a single non-obstructed passage extending substantially across a width dimension thereof and beyond the outer extent of the grid of the regulating portion so as to allow the flow of the particles to pass unimpeded therethrough from the discharge element toward the developing area outside the image area on the photosensitive member surface so that the developing area will have a voltage equal to or greater than the developing voltage, wherein the non-regulating portion is arranged a distance away from the photosensitive member so that no leakage discharge will occur toward the low-insulative portion at the photosensitive member edge from the grid being applied at the predetermined voltage.

15. A charging device for charging a photosensitive member surface on which a toner is supplied to create a toner image, with the same polarity as that of the toner, comprising:

a discharge element for generating charged particles to supply static charge on the photosensitive member surface;

a grid composed of a regulating portion which is disposed opposing the image area, on the photosensitive member surface, on which the toner image is formed, and has a predetermined voltage applied so as to regulate, and make uniform, the flow and passage of the particles from the discharge element toward the image area and at least one non-regulating portion which at least opposes the developing area residing outside the image area and beyond the outer extent of the grid of the regulating portion on the photosensitive member surface, wherein the non-regulating portion includes a non-obstructed passage which allows the flow of the particles to pass unimpeded therethrough from the discharge element toward the developing area outside the image area on the photosensitive member surface so that the developing area will have a voltage equal to or greater than the developing voltage, the non-regulating portion terminating in an outer end member which angulates in a direction away from the photosensitive member and is tensioned at an extremity thereof.

16. The charging device according to claim 15, wherein the passage of the non-regulating portion comprises a single opening extending substantially across a width dimension of the non-regulating portion.

17. The charging device according to claim 15 and additionally including at least one wire extending along mutually opposing outer walls of the non-obstructed passage between the regulating portion and the outer end member for improving the strength of the grid while providing substantially no obstruction to said non-obstructed passage.

18. The charging device according to claim 17 wherein said at least one wire comprises a pair of parallel wires.

19. The charging device according to claim 16 and additionally including at least one wire extending along mutually opposing outer walls of the non-obstructed passage between the regulating portion and the outer end member for improving the strength of the grid while providing substantially no obstruction to said non-obstructed passage.

20. A charging device for charging a photosensitive member surface on which a toner is supplied to create a toner image, with the same polarity as that of the toner, comprising:

a first charger portion of a scorotron mode having an opening of a predetermined size, and including a grid element thereon for charging the image area, on the photosensitive member surface, on which the toner image is formed on the grid member located only at the first charger portion; and a second charger portion of a corotron mode having a single non-obstructed opening therein extending beyond the grid and having a size less than the opening of the first charger portion for charging the non-image area of the photosensitive member surface.

21. The charging device according to claim 20 and additionally including at least one wire extending along mutually opposing outer walls of the non-obstructed opening between the grid element and an outer end member for improving the strength of the grid while providing substantially no obstruction to said non-obstructed opening.

22. The charging device according to claim 21 wherein said at least one wire comprises a pair of parallel wires.

* * * * *